US006197420B1

(12) United States Patent
Takamizawa et al.

(10) Patent No.: US 6,197,420 B1
(45) Date of Patent: Mar. 6, 2001

(54) TRANSFER SUBSTRATE AND TRANSFER SEAL

(75) Inventors: Yukio Takamizawa; Masanobu Maeda, both of Tachikawa (JP)

(73) Assignee: Cosmotec Co., Ltd., Tokyo (JP)

( * ) Notice: Subject to any disclaimer, the term of this patent is extended or adjusted under 35 U.S.C. 154(b) by 0 days.

(21) Appl. No.: 09/298,222

(22) Filed: Apr. 23, 1999

(30) Foreign Application Priority Data

Apr. 27, 1998 (JP) ..... 10-115824

(51) Int. Cl.[7] ..... B44C 1/17; B41M 3/12
(52) U.S. Cl. ..... 428/354; 428/143; 428/914
(58) Field of Search ..... 428/914, 354, 428/143, 149

(56) References Cited

U.S. PATENT DOCUMENTS 5,045,383 * 9/1991 Maeda et al. ..... 428/216

FOREIGN PATENT DOCUMENTS 207499 8/1996 (JP) .

OTHER PUBLICATIONS

JP 1991–195793 Abstract.*
JP 1992–57380 Abstract.*
JP 02 000589 Abstract.*
Derwent of JP 8 207499 A 1996.

* cited by examiner

*Primary Examiner*—Daniel Zirker
(74) *Attorney, Agent, or Firm*—Norris McLaughlin & Marcus P.A.

(57) ABSTRACT

A mat surface layer made of a water-soluble resin mixed with a powder capable of working as a matting agent is formed on an aqueous liquid-permeable sheet material such as water-absorptive paper by coating or the like to produce a transfer substrate. A color printing and/or coating layer is formed either directly or via a protective layer (formed by solid printing or the like) on the mat surface layer of the transfer substrate, followed by forming thereon an adhesive layer made of a pressure-sensitive adhesive or an aqueous liquid-active adhesive by screen printing or the like. An antiblocking separator may be provided on the adhesive layer. The resultant transfer seal can give a mat state to the surface of the transferred portion of the transfer seal remaining on an adherend such as the skin after transfer thereof.

2 Claims, 1 Drawing Sheet

TRANSFER SUBSTRATE AND TRANSFER SEAL

BACKGROUND OF THE INVENTION

1. Field of the Invention

The present invention relates to a transfer substrate and a transfer seal fit for various adherends such as the skin in particular to which it is adhered.

2. Related Art

Various types of transfer seals such for example as tattoo transfer seals are known, which include a water transfer seal, an organic solvent transfer seal, a pressure-sensitive adhesive transfer seal, and the like. Every transfer seal comprises a transfer substrate (e.g., transfer paper coated with paste, or transfer release paper or film treated with silicone resin or the like) as a material to be printed or coated, or the like for forming thereon a design layer (color printing layer, color coating layer, or the like) by printing, coating or the like, the design layer formed by printing, coating or the like, and an adhesive layer made of a water- or solvent-active adhesive or a pressure-sensitive adhesive, and optionally further comprising an antiblocking separator (release paper, release film, or the like).

When a water-transfer type tattoo transfer seal is to be transferred to the skin, the separator, if any, is first removed, and the adhesive layer of water-active or pressure-sensitive adhesive is applied and pressed onto the skin, while wetting the remaining portion of the transfer seal with water to swell and dissolve the paste layer of transfer paper. Then, the transfer paper is slid and separated in the nick of time when the transfer paper becomes separable from the design layer and the adhesive layer, whereby only the design layer and the adhesive layer are left on the skin. In the case of an organic solvent-transfer type tattoo transfer seal, the same transfer procedure as described above is carried out except that wetting with an "organic solvent" is effected instead of wetting with "water."

In the case of a pressure-sensitive adhesive type tattoo transfer seal having a pressure-sensitive adhesive layer as the adhesive layer, removal of the separator is followed by direct attachment of the pressure-sensitive adhesive layer to the skin with using neither water nor any organic solvent, followed by finally peeling off the transfer release paper or film treated with a silicone resin or the like. The basic structure of a pressure-sensitive adhesive type transfer seal, which is not limited to a tattoo transfer seal, is disclosed in Japanese Utility Model Publication No. 36,198/1965. Specifically, this seal is a transfer mark seal comprising a transparent printing layer formed, for example, on release paper (transfer substrate) treated with a silicone resin or the like, a predetermined multicolor printing layer formed by printing on the surface of the transparent printing layer, a pressure-sensitive adhesive layer formed on the surface of the multicolor printing layer, and release paper (separator) adhered to the surface of the adhesive layer. When this seal is used, only the transparent printing layer and the predetermined multicolor printing layer are transferred and adhered to an adherend with the pressure-sensitive adhesive layer therebetween. The transparent printing layer works as a protective layer, which protects the multicolor printing layer after transfer to the adherend.

In every conventional tattoo transfer seal, the transfer substrate thereof is transfer paper coated with paste, or releasable transfer paper or plastic film treated with a silicone resin or the like, on which a design layer is formed either directly or via a protective layer by printing or coating. Thus, either the design layer such as a color printing or coating layer, or the protective layer occasionally provided thereon, which remains on the skin after transfer, is so glossy that it cannot exhibit a touch, or impression, of real tattoo. This is not limited to such a tattoo transfer seal, and there are no transfer seals capable of leaving a design layer or a protective layer occasionally provided thereon in a mat, or delustered, state on an adherend.

Accordingly, an object of the present invention is to provide transfer substrate and transfer seal capable of leaving a mat surface of the transferred portion of the latter on an adherend after transfer of the transfer seal.

SUMMARY OF THE INVENTION

The present invention provides a transfer substrate comprising an aqueous liquid-permeable sheet material and a mat surface layer made of a water-soluble resin mixed with a powder capable of working as a matting agent (delustering agent); and a transfer seal comprising the above-mentioned transfer substrate and a printing and/or coating layer formed either directly or via a protective layer on the mat surface layer of the transfer substrate, and optionally further comprising an adhesive layer made of a pressure-sensitive adhesive or an aqueous liquid-active adhesive and optionally provided with a separator thereon.

The present invention will now be described in detail. Since the transfer seal of the present invention using the transfer substrate of the present invention comprises the printing and/or coating layer formed by printing and/or coating on the mat surface layer of the water-soluble resin mixed with the powder working as the matting agent, the surface of the layer in contact with the uneven mat surface layer is also uneven and mat. Thus, when the water-soluble resin is dissolved and removed with an aqueous liquid (e.g., water or a liquid mixture of water and a water-soluble solvent such as ethanol) after the transfer seal, stripped of the separator if any, is adhered to an adherend such as the skin, the above-mentioned powder is also substantially removed, with the result that the surface of the transferred portion of the transfer seal remaining on the adherend turns out mat, or delustered.

The transfer substrate of the present invention has the mat surface layer formed on the aqueous liquid-permeable sheet material and made of the water-soluble resin mixed with the powder working as the matting agent. Examples of this aqueous liquid-permeable sheet material include water-absorptive paper, a non-woven fabric, and a porous plastic film, among which water-absorptive paper is preferred in respect of permeability. The non-woven fabric and the porous plastic film are preferably hydrophilized to become permeable to aqueous liquids. Where an aqueous liquid containing a water-soluble solvent such as ethanol is used for transfer of the transfer seal, however, the non-woven fabric and the porous plastic film, even if not hydrophilized, may function as the aqueous liquid-permeable sheet material since the water-soluble solvent such as ethanol lowers the surface tension of water.

Examples of the water-soluble resin include polyethylene glycol, polyvinyl alcohol, polyvinylpyrrolidone, sodium alginate, polyacrylic acid, dextrin, and starch, among which dextrin is especially preferred in respect of solubility in water and the like.

Examples of the powder capable of working as the matting agent include silica, calcium carbonate, clay, alumina, and titanium oxide. Silica, clay and the like, which are not so high in refractive index and hence become translucent even when mixed with the water-soluble resin, are advantageous since they enable the position of the colored layer to be almost visually recognized through the transfer substrate even when water-absorptive paper is used as the aqueous liquid-permeable sheet material. The amount of this powder to be mixed with the water-soluble resin is preferably 0.1 to 80 wt. %, more preferably 2 to 40 wt. %, further preferably 3 to 30 wt. %, based on the water-soluble resin though it depends on a desired degree of matting, or delustering.

In the transfer seal of the present invention, the printing and/or coating layer is formed either directly or via the protective layer (formed by printing or coating) on the foregoing transfer substrate, and is optionally provided thereover with the adhesive layer of pressure-sensitive adhesive or aqueous liquid-active adhesive, over which the antiblocking separator may be provided if necessary. The pressure-sensitive adhesive is preferable to the aqueous liquid-active adhesive since the former is capable of easy and secure transfer, but usually requires the separator. The printing and/or coating layer is usually colored. A transparent protective layer is preferably formed between the transfer substrate and the printing and/or coating layer by printing or coating. The adhesive layer may instead be colored to develop the function of the transfer seal. In this case, the printing and/or coating layer may be transparent to function as a protective layer without need of the above-mentioned protective layer. In the case of a tattoo transfer seal, an elastic resin (which may contain a plasticizer) and/or a rubber is preferably used to form a transparent elastic layer as the protective layer since it facilitates attachment of the transfer seal to the skin, prevents cracking of the colored layer (design layer) during service, and facilitates detachment of the transferred portion of the transfer seal after service thereof (Japanese Patent Laid-Open No. 207,499/1996, incorporated herein by reference in its entirety). Without formation of the adhesive layer of pressure-sensitive adhesive or aqueous liquid-active adhesive, the printing and/or coating layer may be used as a solvent-active layer. In this case, when a liquid mixture of water and a water-soluble solvent such as ethanol is used as the aqueous liquid, an adhesiveness of the printing and/or coating layer can be developed with, for example, ethanol to effect transfer of the transfer seal to an adherend.

Additionally stated, the term "color" as used herein is intended to encompass a metallic color, a fluorescence, a phosphorescence, etc. in addition to so-called "various colors" including white and black. The procedure of transferring the transfer seal of the present invention is the same as described hereinbefore in connection with the tattoo transfer seals of water-transfer type and solvent-transfer type.

BRIEF DESCRIPTION OF DRAWING

Other objects, features and advantages of the present invention will be better understood from the following description taken in connection with the accompanying drawing, in which.

PREFERRED MODES FOR CARRYING OUT THE INVENTION

Embodiments of the present invention will be described while referring to the accompanying drawing, but should not be construed as limiting the scope of the present invention. Incidentally, a color printing layer and the like are drawn as continuous ones in FIG. 2, but may sometimes be discontinuous. The figures are simply drawn as conceptual ones wherein the dimensions are not expressed as representing the actual ratios thereof.

Figure 1:
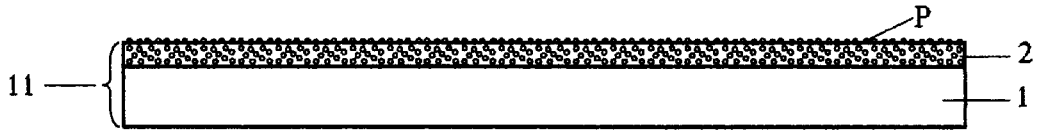
FIG. 1 is a schematic cross-sectional view illustrating the structure of an example of the transfer substrate of the present invention.

A procedure of producing an example of the transfer substrate of the present invention will be described while referring to FIG. 1. A powder P capable of functioning as a matting agent is dispersed in an aqueous solution of a water-soluble resin according to a customary method to prepare a dispersion. This dispersion is applied on an aqueous liquid-permeable sheet material 1 such as water-absorptive paper according to a customary method, and dried to form a mat surface layer 2 of the water-soluble resin mixed with the powder P. A transfer substrate 11 is thus produced. Incidentally, the method of forming the mat surface layer 2 is not limited to application. For example, the dispersion is printed on the aqueous liquid-permeable sheet material 1 by screen printing, gravure printing or the like to form a mat surface layer 2 The dry thickness of the mat surface layer 2, though not particularly limited, is preferably 0.5 to 200 $\mu$m, more preferably 1 to 100 $\mu$m, further preferably 5 to 40 $\mu$m.

Next, a preferred procedure of producing an example of the transfer seal of the present invention will be described while referring to FIG. 2. A monochrome or multicolor printing ink layer is formed as a printing layer 4 either directly or via a protective layer 3 (formed by solid printing or coating, preferably by solid screen printing) by lithographic printing, letterpress printing, gravure printing, intaglio printing such as intaglio transfer printing (pad printing), screen printing, or the like. Particularly in multicolor halftone printing, lithographic printing, letterpress printing and gravure printing are preferred since halftone dots are fine. In screen printing, halftone dots tend to be coarse even when an ultraviolet-curing ink is used. In order to avoid coarse halftone dots in screen printing, image printing (solid) is done using a necessary number of color inks. By contrast, in lithographic, letterpress or gravure printing, even a photographic touch can be manifested using three primary color inks and a black ink. Lithographic printing, letterpress printing and gravure printing are preferred in an aspect of fast printing speed. Lithographic printing and letterpress printing are preferred in aspects of low plate making cost and fast correcting proof. Such printing is preferably done according to sheet-fed or rotary offset printing in as aspect of higher printing speed.

A coating layer may be formed instead of the printing layer 4 by application (this term is intended to encompass coating and solid screen printing) of a solution or dispersion of a film-forming material dissolved or dispersed in a solvent on the transfer substrate. In this case, however, the resultant laminate is usually punched into a certain pattern, which is transferred as a design to an adherend. Printing may also be combined with coating. For example, printing may be followed by coating. The printing and/or coating layer generally contains a resin(s), a variety of filler(s), a variety of colorant(s), and a variety of additive(s). Where an adhesive layer is colored and the printing or coating layer is uncolored, a colorant(s) is contained in the adhesive layer instead of the printing or coating layer. The concept of the term "colorant" as used herein is intended to encompass a wide variety of pigments, dyes, metallic powders, fluorescent substances, phosphorescent substances and light storage substances.

A transparent elastic layer may be used as the protective layer 3. In this case, when the adhesion of the color printing ink layer as the printing layer 4 to the transparent elastic layer is good, the color printing ink layer is not cracked during service even if the transfer seal is adhered to the skin, a flexible or stretchable article, or the like.

If necessary, an adhesive layer 5 made of a pressure-sensitive adhesive or an aqueous liquid-active adhesive is formed on the surface of the printing layer 4 by printing such as screen printing or the like. Usable examples of such a pressure-sensitive adhesive include acrylic, rubber, and silicone pressure-sensitive adhesives. If necessary, the pressure-sensitive or aqueous liquid-active adhesive may be admixed with a variety of additive(s), examples of which include a filler, a white pigment, a metallic powder such as an aluminum powder, a tackifier, a leveling agent, and a defoaming agent.

When the pressure-sensitive adhesive is used, the adhesion of the adhesive layer made of the pressure-sensitive adhesive is not particularly limited, and the preferable value of that adhesion is varied depending on the size of the transfer seal, the kind of adherend, etc. In the case of a tattoo transfer seal, in general, that adhesion is preferably in the range of about 120 g/25 mm width to about 2,000 g/25 mm width, more preferably in the range of about 200 g/25 mm width to about 1,000 g/25 mm width, when measured in accordance with JIS-Z0237.

When the transfer seal of the present invention is used as a tattoo transfer seal, use of only a colorant(s) capable of forming as transparent a colored layer as possible can provide a touch of real tattoo on the skin after transfer.

The transfer seal of the present invention may be provided with one or more air holes through the protective layer, the printing or coating layer and/or the adhesive layer. The air hole(s) can be formed, for example, either by making and using a printing plate capable of air hole formation or by piercing the produced transfer seal with needles. The form of air hole is not particularly limited, examples of which include substantially circular, polygonal, asterisk-like, streaked, spiral, doughnut-like, and wavy forms. When the transfer seal of the present invention is used as a tattoo transfer seal, the air hole(s) enables the skin to come into contact with air, whereby development of a heat rash or an eruption due to an airtight state between the adhesive layer and the skin in the case of no air holes can be diminished. The air hole(s) (e.g., circular holes of preferably about 0.1 mm to about 3 mm, more preferably about 0.2 mm to about 2 mm, in diameter) is preferably formed only through the adhesive layer. In this case, the foregoing effect is well exhibited together with the effect of facilitating peeling off the transferred portion of the transfer seal after service thereof without restricting a design in the colored layer and the beauty thereof.

EXAMPLES

The following Examples will more specifically illustrate the present invention, but should not be construed as limiting the scope of the invention.

Example 1

100 parts by weight of dextrin were dissolved in water to prepare a 30 wt. % aqueous solution of dextrin. 20 parts by weight of silica (OK series) sold by Degussa Japan Co., Ltd. were dispersed in this aqueous solution with a homomixer to prepare a dispersion. This dispersion was applied on water-absorptive paper with an applicator, and then dried to form a mat surface layer having a dry thickness of about 20 μm. Thus, there was produced a transfer substrate having a cross-sectional structure as shown in FIG. 1.

Example 2

Figure 2:
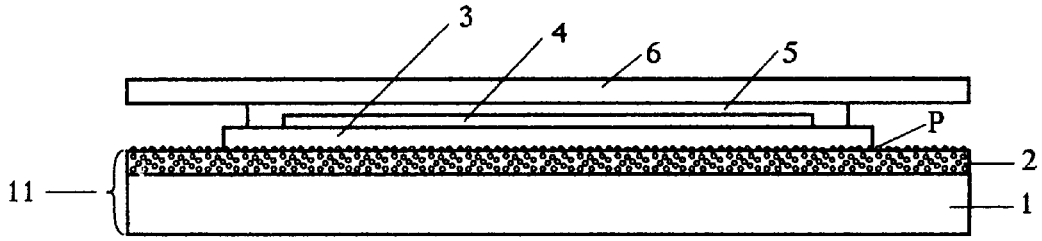
FIG. 2 is a schematic cross-sectional view illustrating the structure of an example of the transfer seal of the present invention.

100 parts by weight of a polyurethane "Miractran" (registered trademark) manufactured by Nippon Polyurethane Industry Co., Ltd. were admixed with 80 parts by weight of a plasticizer "Nippollan" (registered trademark) manufactured by Nippon Polyurethane Industry Co., Ltd. and cyclohexanone to prepare a suitable-viscosity solution, which was then screen-printed on the mat surface layer of the transfer substrate of Example 1 to form a transparent elastic protective layer having a dry thickness of about 15 μm, on which multicolor halftone offset lithographic printing was then done to form a color printing ink layer, on which a solution of a butyl acrylate-ethyl acrylate copolymer acrylic pressure-sensitive adhesive was screen-printed to form a pressure-sensitive adhesive layer having a dry thickness of about 15 μm, on which release paper was then superposed as a separator to produce a transfer seal having a cross-sectional structure as shown in FIG. 2.

The release paper was peeled off, and the pressure-sensitive adhesive layer was then applied on the skin. The transfer substrate was pressed against the skin, and then wetted with water to dissolve dextrin. The water-absorptive paper was turned over and peeled off to effect transfer. The surface of the transferred portion of the transfer seal remaining on the skin was in a mat state. Incidentally, silica was substantially removed during dissolution of dextrin.

At least one layer comprising at least a colored layer is formed on the mat surface layer of the transfer substrate of the present invention to produce a transfer seal. After transfer, the surface of the layer that has been in contact with the mat surface layer becomes mat, or delustered.

The transfer seal of the present invention provides a mat state for the surface of the transferred portion of the transfer seal remaining on an adherend such as the skin after transfer thereof due to the effect of the mat surface layer of the transfer substrate. Thus, when it is used, for example, as a tattoo transfer seal, it can give a touch of real tattoo to the skin.

Although the transfer seal of the present invention can advantageously be used as a tattoo transfer seal as described above, it can also be used as a transfer seal for a variety of article as an adherend, examples of which include a leather jumper, a leather bag, various balls (it may be used as an autograph transfer seal), metal products, glass products, pottery, and plastic moldings.

What is claimed is:

1. A transfer substrate comprising an aqueous liquid-permeable sheet material and a mat surface layer made of a water-soluble resin mixed with a powder capable of working as a matting agent.

2. A transfer seal comprising a transfer substrate as claimed in claim 1 and a printing and/or coating layer formed either directly or via a protective layer on the mat surface layer of said transfer substrate, and optionally further comprising an adhesive layer made of a pressure-sensitive adhesive or an aqueous liquid-active adhesive and optionally provided with a separator thereon.

* * * * *